United States Patent [19]

Fukae et al.

[11] Patent Number: 4,639,116

[45] Date of Patent: Jan. 27, 1987

[54] PRINTER/COPIER WITH DISPOSABLE TONER CARTRIDGE

[75] Inventors: Kensuke Fukae, Allendale, N.J.; Keitaro Yamashita, Saitana, Japan

[73] Assignee: Kentek Information Systems, Inc., Allendale, N.J.

[21] Appl. No.: 718,946

[22] Filed: Apr. 2, 1985

[51] Int. Cl.[4] ..... G03G 15/08

[52] U.S. Cl. ..... 355/3 DD; 355/14 D; 222/DIG. 1; 430/30; 430/102

[58] Field of Search ..... 355/3 DD, 3 R, 14 D; 206/633; 222/DIG. 1, 171, 167; 118/653; 229/11, 175 C, 175, 4.5; 430/30, 102

[56] References Cited

U.S. PATENT DOCUMENTS

| | | | |
|---|---|---|---|
| 2,904,000 | 9/1959 | Fisher et al. | 118/653 X |
| 3,339,807 | 9/1967 | Eichorn | 222/171 |
| 3,385,500 | 5/1968 | Lavander | 229/11 X |
| 4,364,656 | 12/1982 | Yanagawa | 355/3 R X |
| 4,478,512 | 10/1984 | Zoltner | 355/3 DD |
| 4,491,161 | 1/1985 | Tamura et al. | 355/3 DD X |
| 4,499,169 | 2/1985 | Haneda et al. | 430/102 |
| 4,514,480 | 4/1985 | Wada et al. | 430/30 |
| 4,523,834 | 6/1985 | Pelda et al. | 355/3 DD |
| 4,540,268 | 9/1985 | Toyono et al. | 355/3 R |

*Primary Examiner*—A. C. Prescott

*Attorney, Agent, or Firm*—Marmorek, Guttman & Rubenstein

[57] ABSTRACT

A developer unit for use in connection with an electrophotographic printer is disclosed. Toner is provided to the developer unit by means of a disposable cartridge so that maintenance requirements are significantly reduced. The developer includes a sensing circuit which measures the inductance of the toner/carrier mix and controls the rate at which toner is introduced into the toner carrier mix.

18 Claims, 3 Drawing Figures

PRINTER/COPIER WITH DISPOSABLE TONER CARTRIDGE

FIELD OF THE INVENTION

This invention relates to electrophotographic printing machines, and more particularly to a toner cartridge for use in connection with such printing machines.

BACKGROUND OF THE INVENTION

Electrophotographic printing is achieved by a process which includes the step of uniformly charging a photoconductive surface and exposing the uniformly charged photoconductive surface to a light source so as to discharge selected portions of the photoconductive surface thereby forming a latent electrostatic image. The latent electrostatic image is developed by applying toner to the discharged portions of the photoconductive member. The applied toner is then transferred to a medium such as paper on which the copy of the image is to be formed. The term electrophotographic printing as used herein is intended to encompass electrophotographic printing and electrophotographic copying.

Such apparatus includes a developer unit operative to deliver toner to the photoconductive member. Typically, the toner is stored in a hopper where it is mixed with a suitable carrier. Typically the carrier comprises iron or other metal particles. When mixed with the carrier, the toner acquires a suitable electrostatic charge so that it may easily be transferred to the photoconductive belt to develop the latent electrostatic image formed thereon.

The developer unit requires considerable maintenance to insure that the proper ratio of toner to carrier is present to produce satisfactory copies. If the toner to carrier ratio is too high too much toner is deposited on the photoconductive surface and the resulting printed copies will smear. If the toner to carrier ratio is too low too little toner is deposited on the photoconductive belt and the resulting printed copies will be too light. Consequently, easy access to the developer unit is required to allow maintenance of the developer unit.

In some electrophotographic apparatus, the entire developer unit is removable. One problem with such removable developer units is that the spacings between the developer unit and the photoconductive surface should be maintained within certain tolerances. Such tolerances are difficult to maintain when the developer unit is constantly removed. Accordingly, relatively expensive alignment mechanism are required to maintain the appropriate spacing between the developer unit and the photoconductive surface while simultaneously permitting removal of the developer unit. U.S. Pat. No. 4,203,386, issued to Blochl et al. May 20, 1980 describes one such alignment mechanism.

BRIEF DESCRIPTION OF THE INVENTION

The invention is based on the recognition that, by far, the maintenance of the developer unit primarily relates to the replenishment of the toner at the proper rate. Accordingly, the toner is provided herein in a disposable cartridge having a top opening. The cartridge is inserted into a sleeve which allows the cartridge to be rotated into a suitable position for use. The toner cartridge is rotated within the sleeve to move the top opening into a position for supplying toner to a metering shaft. The metering shaft controls the amount of toner which enters a mixing chamber containing the carrier particles. Thus the toner to carrier ratio in the mixing chamber is maintained within desired limits.

By providing a disposable cartridge in this manner, alighnment considerations are eased because the alignment of the developer unit and the photoconductive surface is not impaced when the toner cartridge is changed. The cartridge is inserted into a position where critical tolerances are not a consideration and the developer unit is moved as a whole rather infrequently.

The toner to carrier ratio in this mixing chamber is monitored by a sensing circuit which tracks the magnetic properties of the toner/carrier mix. Those properties change as the toner/carrier mix changes. The sensing circuit is operative to signal a microprocessor. The microprocessor controls a motor which rotates the metering shaft in a manner to regulate the flow of toner from the toner cartridge into the mixing chamber so that the toner to carrier ratio is within the desired limits.

The combination of a disposable toner cartridge and sensing circuit virtually eliminates maintenance of the developer unit. The circuit operates to eliminate the requirement for periodic manual addition of toner for controlling the toner/carrier mix and the disposable cartridge permits simple replacement of the toner when depleted.

BRIEF DESCRIPTION OF THE DRAWING

FIG. 4 is a phase and amplitude diagram which explains the operation of the circuit of FIG. 3.

DETAILED DESCRIPTION

Figure 1:
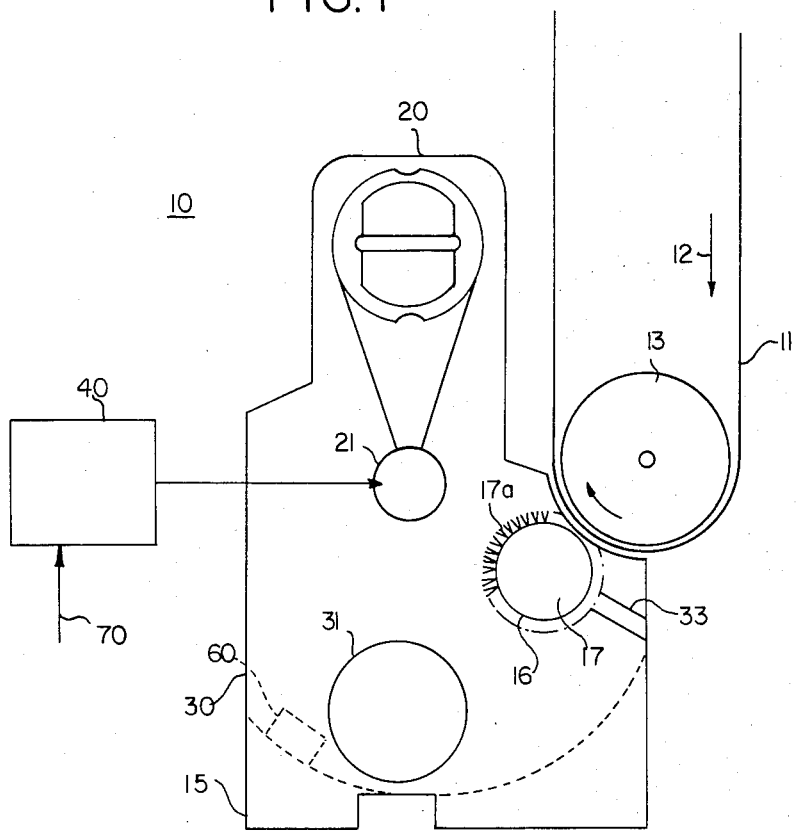
FIG. 1 is a partly cross-sectional and partly perspective view of a developer unit for use in an electrophotographic printer in accordance with an illustrative embodiment of the present invention.
Figure 2:
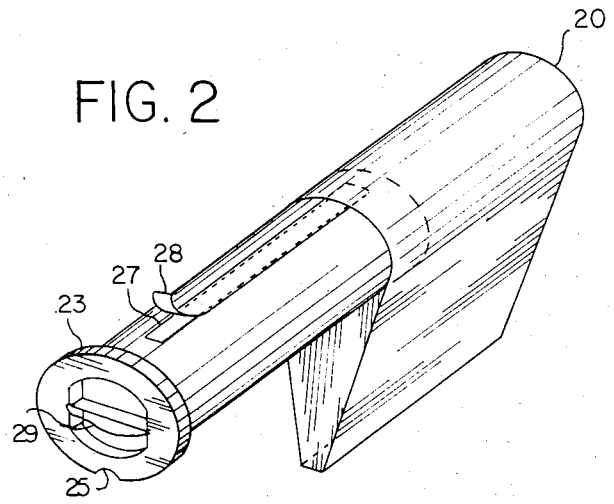
FIG. 2 shows a cartridge for use in the developer unit of FIG. 1.

FIG. 1 shows a schematic side or end view of a typical developer unit 10. The developer unit 10 is adapted to apply toner to selective portions of the belt 11 to develop a latent electrostatic image formed thereon. The belt 11 is movable in the direction of arrow 12 by means of roller 13. Preferably, a uniform spacing of 1.6 mm is maintained between the photoconductive belt 11 and a toner delivery roller 16 which delivers toner from the developer 10 to the photoconductive belt 11. The main body of the developer unit 10 includes a sleeve 20 shown more fully in FIG. 2. The lower portion of sleeve 20 has a funnel shaped cross section and is positioned to interact with a metering shaft 21 shown in FIG. 1 at the lower end of the funnel. The upper portion of the sleeve 20 is adapted to receive a toner cartridge 23.

The toner cartridge 23 is designed to be disposable. Illustratively, the toner cartridge comprises a rigid cardboard tube which is sealed at one end (not shown) with a cardboard disk. The other end of cartridge 23 has a notch 25, which notch is aligned diametrically opposite top opening 27. The cartridge is inserted with opening 27 facing upward and notch 25 facing downward. An adhesive strip 28 is removed prior to insertion to expose the toner contents of the cartridge.

Cartridge 23 is inserted and rotated 180° to deliver toner to the developer unit. The cartridge is typically formed from a cardboard tube and includes a handle 29 which is rotated until notch 25 faces upward. The rotation moves opening 27 into a position facing the metering shaft 21. The metering shaft is operative to meter toner from cartridge 23 into the mixing chamber 30.

Mixing chamber 30 contains the carrier for the toner. The carrier conveniently comprises small filings of ferrous particles which are magnetic. The toner is added to the mixing chamber and mixed with the carrier by auger shaft 31. The roller brush 16 moves the toner carrier mix from chamber 30 and delivers the toner in the mix to the photoconductive member to develop an image. Doctor blade 33 serves to control the amount of carrier and toner on the roller brush 16.

Formation and development of the latent electrostatic image formed on the photoconductive belt 11 can be understood in rough terms as follows. First the photoconductive belt is uniformly charged to a relatively high negative potential on the order of −600 volts. An optical print head is used to discharge selective portions of the belt to a much lower potential on the order of −150 Volts. Thus the latent electrostatic image comprises −150 Volt portions surrounded by −600 Volt background regions. Electrostatic forces are used to attract toner to the −150 Volt portions while toner is repelled from the −600 Volt regions, thereby causing development of the latest electrostatic image.

When the toner particles and carrier particles are mixed together in the mixing chamber 30 of developer 10, opposite triboelectric charges are formed on the carrier and toner particles. These electrostatic charges cause the toner and carrier particles to be attracted to each other. This in turn prevents the toner particles from forming relatively large aggregations so that toner maintains a powder form. As a result of interactions with the carrier particles, the toner acquires a charge on the order of −100 Volts while the carrier particles acquire a positive charge.

When the toner is to be applied to the photoconductive belt 11, the roller 16 is charged to about −400 Volts by conventional charging circuitry (not shown). The −400 Volt potential causes the toner to become separated from the oppositely charged carrier particles. The positively charged carrier particles are attracted to −400 Volt roller brush 16. Attraction of the carrier particles to the rollerbrush 16 is aided by the fact that the roller 17 and bristles **17*a*** are formed from a magnetic material as are the carrier particles. On the one hand the −100 Volt toner particles are attracted to the "relatively positive" −150 Volt discharged regions of the photoconductive belt while being repelled from the −600 Volt regions of the photoconductive belt.

After a developed image has been transferred from the photoconductive belt 11 to paper, excess toner should be removed from the photoconductive belt 11. This is accomplished by changing the potential on the photoconductive belt to something on the order of −100 to −50 Volts while simultaneously changing the bias on the roller brush 16 to about +150 Volts. This causes the toner particles to be repelled from the photoconductive belt 11 and attracted to the roller brush 16. Thus excess toner is carried back into the mixing chamber 30 by the roller brush 16.

It is to be understood that the voltages stated in the aforementioned example are stated merely to explain how the developer unit operates. While typical developer units operate in accordance with the principles illustrated by the foregoing example, the actual voltages to which the various components are charged may be different.

The mix of toner and carrier in the mixing chamber 30 is monitored automatically by a monitoring circuit which controls the motor 40 which rotates metering shaft 21. The circuit is adapted to sense changes in the inductance of the toner carrier mix, which inductance depends on the ratio of toner to carrier.

Figure 3:
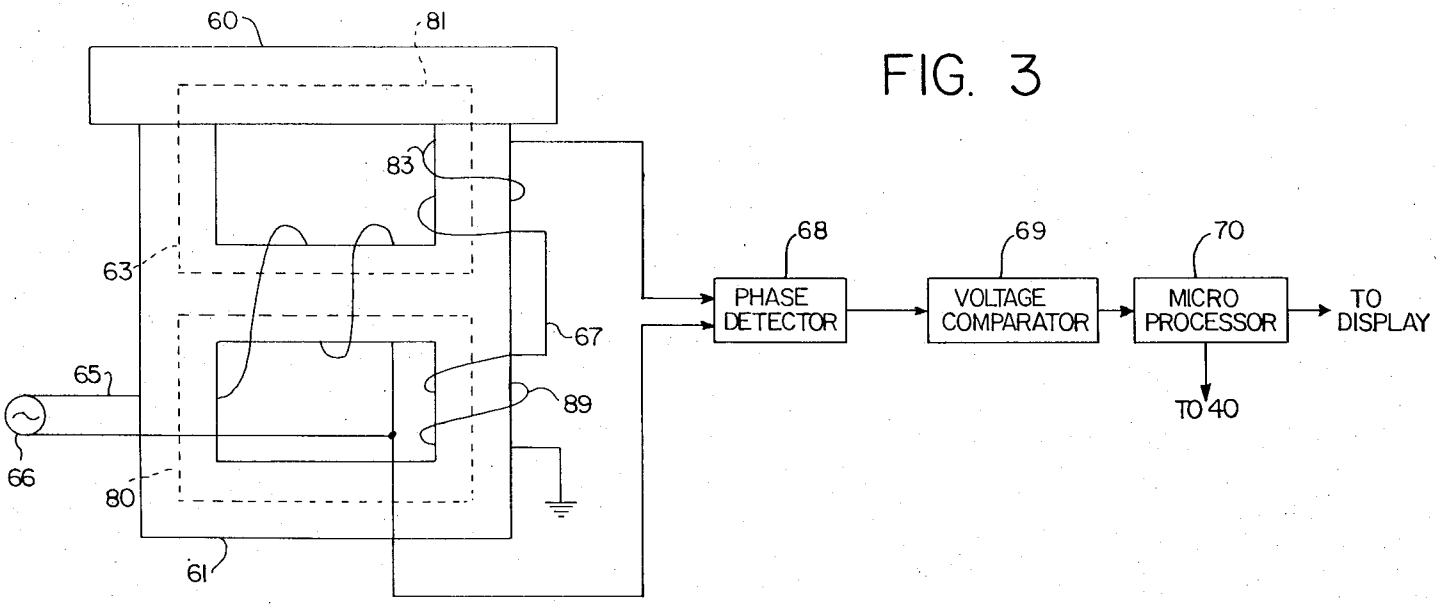
FIG. 3 is a circuit diagram of a circuit which monitors the toner/carrier mix in the apparatus of FIG. 1.

FIG. 3 shows the monitoring circuit as including a double apertured magnetic core 61. One leg 60 of the core 61 is in contact with the toner carrier mix as shown in FIG. 1. The center leg 63 of the core includes a primary winding 65 driven at 200 to 300 hertz by oscillator 66. A secondary winding 67 couples the two cores. The secondary winding is connected between ground an input to phase detector 68. The primary winding also is connected to an input to phase detector 68. The output of the phase detector is connected to the input of voltage comparator 69. The output of comparator 69 is connected to an input of microprocessor 70. Microprocessor 70 is operative to activate motor 40 of FIG. 1 to rotate metering shaft 21 when the inductance of the toner/carrier mix indicates a deficiency of toner. The movement of the shaft introduces more toner to be mixed into the mixing chamber 30.

As can be seen from FIG. 3, core 61 includes two flux paths 80 and 81. Flux path 80 is completed through leg 60 which is in contact with the toner/carrier mix in chamber 30 of FIG. 1. The mix effects the coupling between the primary winding and the portion 83 of the secondary winding coupling flux path 81. A change in phase occurs with respect to the voltage in the primary which change in phase depends on the toner carrier mix. Phase detector 68 compares the phases and applies a voltage, proportional to the difference, to comparator 69. Comparator 69 compares the input voltage to a reference voltage and applies a signal to microprocessor 70. Microprocessor 70 includes an algorithm to control motor 40.

Microprocessor 70 of FIG. 3 can be used to drive a display (not shown) which indicates the need for toner cartridge replacement. A signal for such replacement may be generated when the microprocessor operation of motor 40 is unable to change the inductance of the toner carrier mix.

Finally, the above described embodiments of the invention, are intended to be illustrative only. Numerous alternative embodiments may be devised by those skilled in the art without departing from the spirit and scope of the following claims.

We claim:

1. A self-contained developer unit for use in connection with an electrophotographic printing apparatus, said developer unit comprising a substantially closed housing, means for receiving a disposable cartridge containing toner, a mixing chamber wherein said toner and a carrier are mixed, means for delivering controlled amounts of toner from said cartridge to said mixing chamber, circuit means for monitoring the toner/carrier mix in said mixing chamber, means coupled to said delivering means for controlling the amount of toner delivered from said toner cartridge to said mixing chamber in response to signals generated by said circuit means, means coupled to said mixing chamber for mixing said toner with carrier particles, and means coupled to said mixing chamber for applying said toner/carrier mix to a photoconductive element to develop a latent electrostatic image, said housing substantially enclosing said disposable cartridge receiving means, said mixing chamber, said delivery means, said mixing means, and said means for applying said toner/carrier mix to said photoconductive element, and at least partially enclosing said circuit means.

2. The developer of claim 1 wherein said toner cartridge receiving means comprises a funnel shaped sleeve.

3. The developer unit of claim 1 wherein said toner delivery means comprises a metering shaft.

4. The developer unit of claim 1 wherein said means for mixing said toner and said carrier particles comprises an auger shaft.

5. The developer unit of claim 1 wherein said means for applying said toner to said photoconductive surface comprises a roller formed from a magnetic material and bristles extending outward from said roller.

6. The developer unit of claim 3 wherein said circuit means is adapted to sense changes in the inductance of the toner carrier mix in said mixing chamber.

7. The developer unit of claim 6 wherein said control means comprises a motor coupled to said metering shaft, said circuit providing signals for turning said motor on and off.

8. The developer unit of claim 1 wherein said circuit means comprises a double-apertured magnetic core having three legs, one of said legs being in contact with said toner/carrier mix in said mixing chamber.

9. The developer unit of claim 8 wherein said circuit means includes primary and secondary windings wound about said legs, the leg in contact with said toner/carrier mix bearing said primary winding.

10. The developer unit of claim 9 wherein said circuit means includes a phase detector for detecting phase differences between voltages carried in said primary and secondary windings.

11. A self-contained developer unit for use in connection with an electrophotograhic printing apparatus, said developer unit comprising a substantially closed housing, a funnel shaped sleeve for receiving a disposable cartridge toner, a mixing chamber wherein said toner and a carrier are mixed, a metering shaft for delivering controlled amounts of toner from said cartridge to said mixing chamber, circuit means for monitoring the toner/carrier mix in said mixing chamber, a motor coupled to said metering shaft for controlling the amount of toner delivered from said toner cartridge to said mixing chamber in response to signals generated by said circuit means, an auger shaft within said mixing chamber for mixing said toner with said carrier, and a roller within said mixing chamber formed from a magnetic material and bristles extending outward from said roller for applying said toner/carrier mix to a photoconductive element to develop a latent electrostatic image, said housing substantially enclosing said funnel shaped sleeve, said mixing chamber, said metering shaft, said auger shaft, and said roller, and at least partially enclosing said circuit means.

12. The developer unit of claim 11 wherein said circuit means is adapted to sense changes in the inductance of the toner/carrier mix in said mixing chamber.

13. The developer unit of claim 12 wherein said circuit means comprises a magnetic core having three legs, said three legs defining a pair of apertures for said core, one of said legs being in contact with said toner/carrier mix in said mixing chamber.

14. The developer unit of claim 13 wherein said circuit means further comprises primary and secondary windings wound about said legs, said primary and secondary windings carrying respective voltages and being electromagnetically coupled together, the leg in contact with said toner/carrier mix bearing said primary winding.

15. The developer unit of claim 14 wherein said circuit means further comprises a phase detector receiving said primary and second voltages and generating a voltage proportional to the phase differences between said primary and secondary voltages.

16. The developer unit of claim 15 wherein said circuit means further comprises a voltage comparator comparing said voltage generated by said phase detector to a reference voltage and generating a signal in response thereto.

17. The developer unit of claim 16 wherein said circuit means further comprises a microprocessor receiving said signal from said voltage comparator and actuating said motor.

18. A device for controlling the toner/carrier mix in a mixing chamber of a developing unit of an electrographic printing apparatus, comprising means for storing toner, means for delivering said toner to said mixing chamber, and circuit means for monitoring the toner/carrier mix in said mixing chamber, said circuit means comprising a magnetic core having two outer legs and a central leg, said three legs defining a pair of apertures for said core, a first outer leg of said core being in contact with said toner/carrier mix, a primary winding wound about said central leg, said primary winding carrying a primary voltage with a phase dependent upon the toner/carrier mix, a secondary winding coupling said pair of apertures, said secondary winding carrying a secondary voltage, a phase detector receiving said primary and secondary voltages and generating a voltage proportional to the phase difference between said primary and secondary voltages, a voltage comparator comparing said voltage generated by said phase detector to a reference voltage and generating a signal in response thereto, and a microprocessor receiving said signal from said voltage comparator and actuating said delivery means.

* * * * *